United States Patent [19]

Falcioni

[11] 4,192,058

[45] Mar. 11, 1980

[54] HIGH FATIGUE SLUG SQUEEZE RIVETING PROCESS USING FIXED UPPER CLAMP AND APPARATUS THEREFOR

[75] Inventor: Joseph G. Falcioni, Tacoma, Wash.

[73] Assignee: The Boeing Company, Seattle, Wash.

[21] Appl. No.: 840,847

[22] Filed: Oct. 11, 1977

[51] Int. Cl.[2] ..... B23P 19/00

[52] U.S. Cl. ..... 29/526 A; 29/243.53; 29/509

[58] Field of Search ..... 29/509, 522, 526, 243.53, 29/243.54; 227/61, 62; 85/37, 39; 72/416

[56] References Cited

U.S. PATENT DOCUMENTS

| | | | |
|---|---|---|---|
| 1,365,664 | 1/1921 | Cox | 29/243.54 |
| 3,557,442 | 1/1971 | Speller | 29/526 |
| 3,561,102 | 2/1971 | Diemer | 29/509 |
| 3,634,928 | 1/1972 | Falcioni | 29/509 |
| 3,646,660 | 3/1972 | Sheffer, Jr. | 29/243.53 |
| 3,874,070 | 4/1975 | Falcioni | 29/243.53 X |
| 3,948,427 | 4/1976 | Claydon et al. | 29/243.54 X |

*Primary Examiner*—Leon Gilden

*Attorney, Agent, or Firm*—Christensen, O'Connor, Johnson & Kindness

[57] ABSTRACT

A high fatigue slug squeeze riveting process using two clamps, one of which is a fixed position clamp, and an apparatus for carrying out the process is disclosed. A pair of panels or other items to be riveted together are clamped by upper and lower clamps and a hole is drilled through the items. Thereafter, a nonheaded rivet slug is inserted in the hole. After insertion of the slug, upper and lower rams approach the rivet along vertical, axially aligned paths. The upper ram is flanked by a pair of spring-loaded rods, known as pogo feet, which extend past the impinging face of the ram. The lower ram stops at a predetermined position, providing a positioning stop for the rivet slug. The upper ram continues down. Since the pogo feet extend past the impinging face of the upper ram, they contact the adjacent surface of the items to be riveted prior to the upper ram contacting the rivet slug. As a result, the pogo feet push the items to be riveted away from the upper, fixed position clamp prior to the upper ram contacting the rivet slug. The upper ram stops and is locked in position after it bottoms out. At this time, the rivet slug is in position within the hole such that predetermined portions of the slug protrude past the outer surfaces of the panels. The lower ram then moves upwardly, and the rivet becomes captive between the forming surfaces of the upper and lower rams. The ram squeeze force applied to the rivet slug first partially forms the lower head of the rivet. As the lower ram forms the lower head, force produced by the lower ram is partially transferred through the rivet to the items to be riveted, which in turn exert an upward force on the pogo feet that overcomes the spring load on the pogo feet. As a result, the pogo feet, items to be riveted and the rivet are pushed upwardly. The upward movement of the rivet is terminated against the upper ram. This causes the upper head of the rivet to be formed, while the lower head formation is completed.

13 Claims, 9 Drawing Figures

Fig. 1.
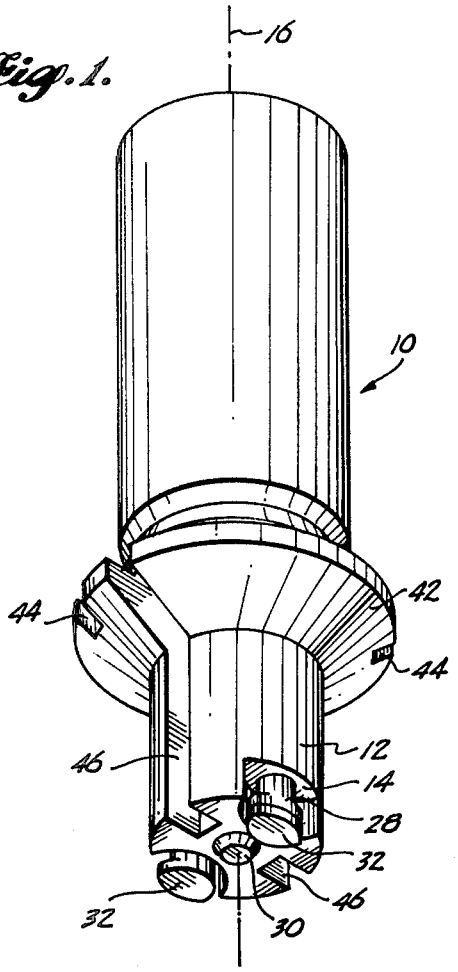
Fig. 2.
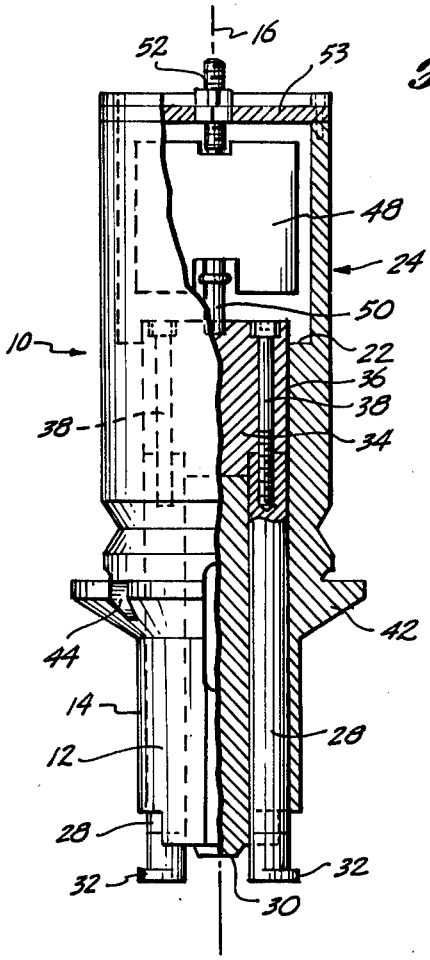
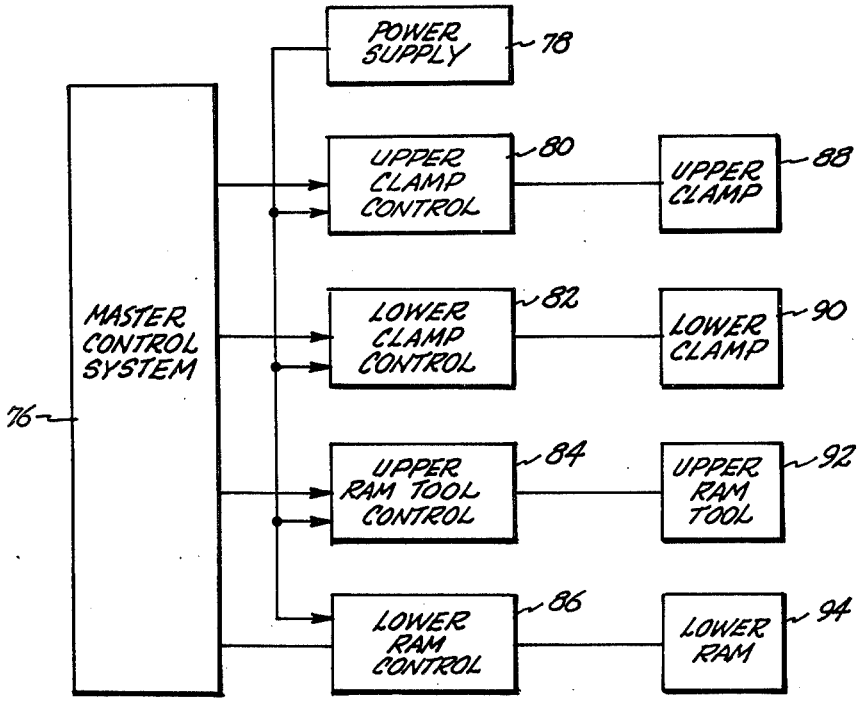
Fig. 5.

HIGH FATIGUE SLUG SQUEEZE RIVETING PROCESS USING FIXED UPPER CLAMP AND APPARATUS THEREFOR

BACKGROUND OF THE INVENTION

This invention relates to riveting processes and apparatus and, more particularly, to riveting processes and apparatus wherein a nonheaded rivet slug is squeezed between a pair of rams.

Several squeeze-type riveting processes using nonheaded rivet slugs are known in the prior art. In many of these processes, a gap must exist between the items being riveted together and the upper clamp that holds the workpiece during part of the rivet forming process, in order to provide room for the upper rivet head to be formed. Such prior art methods of squeeze-type riveting generally use either a machine having a floating upper clamp or a retractable upper clamp to attain the desired gap. However, many riveting machines exist that have a fixed upper clamp assembly, which, in the past, has prevented them from using nonheaded rivet slugs. As a result, such machines have been required to use expensive, headed rivet blanks. Obviously, it would be desirable to modify the operation of such machines in a manner that would allow them to be used with inexpensive nonheaded rivet slugs.

In this regard, prior art riveting machines that have fixed upper clamps and use nonheaded rivet slugs are known. These machines operate in accordance with what is known as the squeeze-vibrate riveting process. In the squeeze-vibrate process the lower head of the rivet is formed by exerting a squeeze force on the lower end of the rivet slug. The upper head is formed by a series of sharp, hammer-like blows on the upper end of the rivet slug by the upper ram. The primary disadvantage of rivet joints formed using the squeeze-vibrate process is that they have a fatigue life that is lower than rivet joints in which both rivet heads are formed entirely by squeeze forces, that is, by a squeeze-squeeze process. Another disadvantage is that the vibrate force is difficult to accurately regulate.

The lower fatigue life of rivet joints formed by the squeeze-vibrate process is due to the nonlaminar interference pattern which forms in the workpiece adjacent the rivet hole during the vibrate portion of the riveting process. As the rivet slug is deformed to form the rivet heads, the shank of the slug within the rivet hole in the workpiece expands radially. As the slug expands, it first fills the rivet hole and then expands the hole slightly, forming a rigid joint. In the vibrate portion of the squeeze-vibrate process, force is applied to the upper end of the rivet slug in short, high-energy strokes. The periodic application of energy causes the expansion of the slug to occur in small increments. The series of short, high-energy impulses causes a step differential (nonlaminar) expansion of the rivet at the work piece interface. During use of the workpiece after assembly, fatigue cracks originate at the interface and cause deterioration of the rivet joint. The rivet joint thus loses its strength in a relatively short time. Consequently, it is desirable to eliminate the vibrate portion of the riveting process and use a squeeze-squeeze process, since a squeeze-squeeze process produces rivet joints that are less likely to have nonlaminar interference patterns.

It is therefore an object of this invention to provide a new and improved high fatigue, slug squeeze riveting process and apparatus using nonheaded rivet slugs.

It is a further object of this invention to provide a process and apparatus which will allow high fatigue, slug squeeze riveting to be accomplished on machines having a fixed upper clamp using nonheaded rivet slugs.

It is another object of this invention to provide apparatus adapted to modify existing machines having fixed upper clamps so as to make such machines useful for producing high fatigue, slug squeeze rivet joints using nonheaded rivet slugs.

SUMMARY OF THE INVENTION

In accordance with the principles of this invention, a high fatigue, slug squeeze riveting process and apparatus for carrying out the process on a machine having a fixed upper clamp is provided. Two panels, or the like, to be joined are clamped together between a pair of clamps and a hole is drilled through the panels. A nonheaded rivet slug is then installed in the hole. All this is accomplished in accordance with the prior art techniques. Thereafter, the steps of the process disclosed by this invention are carried out.

In accordance with the invention, rams approach the rivet slug from either end. The upper ram has a pair of pogo feet, located on opposing sides of the rivet, that extend past the rivet-impinging face of the ram. The pogo feet are located at the end of spring-loaded shafts. As the upper ram approaches the slug, the pogo feet impinge upon the workpanels, gently pushing them away from the fixed upper clamp, prior to the ram impinging on the rivet slug. The pogo feet push the panels away, until the upper ram impinges on the end of the slug, at which time the upper ram is locked in position. Up to this time, the lower ram has been stationary, providing a support upon which the slug rests as the upper ram and foot assembly come into position. When the upper ram is locked in position, portions of the slug extend past the surfaces of the panels whereby the rivet slug is positioned such that head formation can begin. Now the lower ram begins to move upwardly, placing a squeeze force on the slug and upsetting the lower end, thereby partially forming a head. After the lower head is partially formed, the force exerted by the lower ram on the slug is partially transferred through the lower head to the workpanel. At some point the force of the lower ram overcomes the force exerted by the spring-loaded pogo feet of the upper ram tool, and the workpanels begin to move upwardly. When such movement occurs, the slug is forced against the upper ram and a head is formed on the upper end of the rivet, as the lower head is completed. The distance by which the pogo feet extend beyond the face of the upper ram provides an upper cavity or gap in which the upper head is formed. Once the squeeze rivet process is completed, the upper ram and tool assembly retracts and the panels are once again clamped together for further finish processing, such as, shaving the upper head to give a smooth surface, as required in the air frame industry.

It will be appreciated from the foregoing brief summary that a new and improved high fatigue, slug squeeze riveting process and an apparatus for use in carrying out the process is provided by the invention. It will also be appreciated that the invention provides a slug squeeze riveting and apparatus useful in a machine having a fixed upper clamp, thereby allowing such machines to use nonheaded rivet slugs without requiring a major modification of the machines.

Using a ram tool formed in accordance with the principles of this invention allows both heads of the rivet to be formed by application of squeeze forces, thereby eliminating the vibrate portion of the prior art squeeze-vibrate riveting process. As noted above, a joint formed by a squeeze-squeeze process has a higher fatigue life than a joint formed by a squeeze-vibrate process, due to the formation of a laminar interference pattern; a result not obtainable by the squeeze-vibrate riveting process. Moreover, the forces applied during a squeeze-squeeze process are more readily controlled and, therefor, more repeatable.

BRIEF DESCRIPTION OF THE DRAWINGS

The foregoing objects and many of the attendant advantages of this invention will become more readily appreciated as the same becomes better understood by reference to the following detailed description, when taken in conjunction with the accompanying drawings wherein:

FIG. 1 is a perspective view of a ram tool formed in accordance with the invention and useful in modifying existing fixed upper clamp riveting machines such that they can perform riveting using nonheaded rivet slugs;

FIG. 2 is a side elevational view, partially in section, of the ram tool illustrated in FIG. 1;

DESCRIPTION OF THE PREFERRED EMBODIMENT

Figures 3A, 3B, 3C, 3D, 3E:
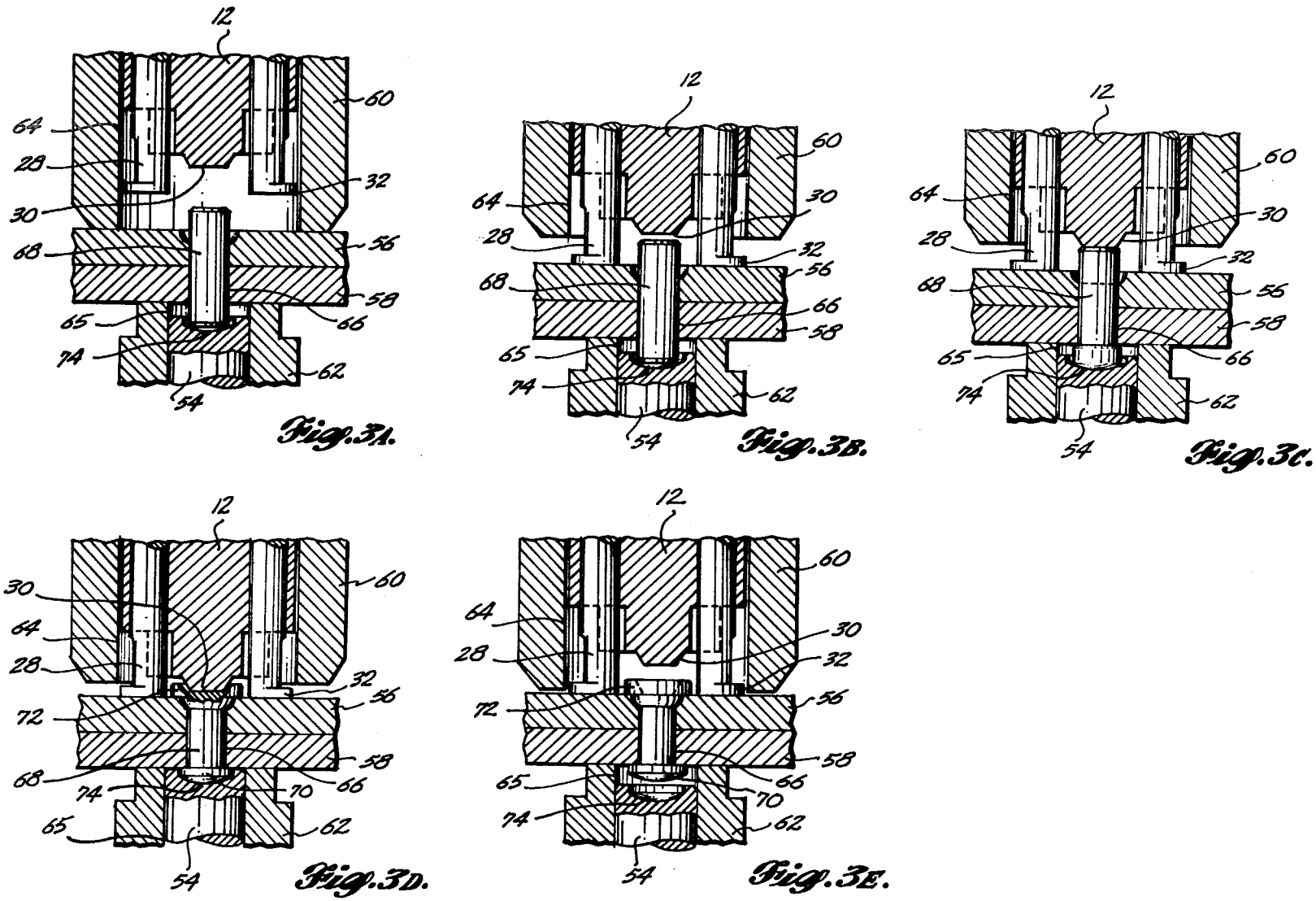
FIGS. 3A–E are cross-sectional diagrams illustrating clamps and rams and the sequence of movement thereof in accordance with the process of the invention.

FIG. 1 shows a preferred embodiment of an upper ram tool 10 formed in accordance with this invention. It is this ram tool that enables the process of this invention to be carried out using a riveting machine (not shown) having a fixed position upper clamp. As a result, the ram tool is described prior to the process being described.

The upper ram tool 10 is generally cylindrical in shape and includes a ram 12 located on one end. The ram 12 is a solid metal cylinder having two parallel, cylindrical pogo rod apertures 14 formed longitudinally therein, one on either side of and parallel to the axial centerline 16 of the ram tool. The pogo rod apertures 14 extend through the ram 12 and terminate at a first cavity 18 located at the other end (top) of the ram. The first cavity 18 is cylindrical and coaxial with the ram 12. The first cavity 18 is of a diameter large enough to encompass both pogo rod apertures 14.

The outer wall 20 of first cavity 18 extends upwardly as viewed in FIG. 2 and terminates at a first shoulder 22. The first shoulder 22 defines a plane perpendicular to the axial centerline of the ram tool 10 and extends outwardly from the axial centerline of the ram tool, terminating at second outer wall 24. Second outer wall 24 extends upwardly from the shoulder 22 and defines a second, cylindrical cavity 26 coaxial with first cavity 18 but of larger diameter.

A pogo rod 28 is slidable mounted in each of the pogo rod apertures 14. Each pogo rod 28 is cylindrical and is of length sufficient to extend beyond the rivet impinging face 30 of the ram 12, the rivet impinging face being the face of ram 12 adjacent to the outer extensions of the pogo rods. Each pogo rod 28 has a pogo foot 32 formed in its outer extension. Each pogo foot 32, as illustrated, is elliptical in shape as viewed along the longitudinal axis of the rod 28; however, the shape could be circular or rectangular. Each pogo foot 32 is larger than the diameter of is associated pogo rod aperture 14; thus the pogo feet cannot retreat into the pogo rod apertures 14.

A cylindrical anchoring slug 34, of diameter substantially equal to that of first cavity 18, is slidably mounted within first cavity 18. The longitudinal dimension of the anchoring slug 34 is sufficient to allow it to extend a short distance into second cavity 26. Two holes 36 are drilled in the slug 34 coaxial with pogo rod apertures 14. The holes 36 are of diameter smaller than the pogo rods 28. Machine screws 38 are inserted through each of the holes 36 and threaded into threaded longitudinal holes 40 formed in the adjacent ends of the pogo rods 28.

In accordance with the foregoing assembly, the pogo rods 28 can move longitudinally within the pogo rod apertures 14 but remain captive. The pogo feet 32 and anchoring slug 34 act as position stops to prevent excess longitudinal movement of the pogo rods.

As illustrated in FIGS. 1 and 2, the ram tool 10 of this invention has a beveled flange 42 extending outwardly around its perimeter. The flange is longitudinally located a short distance from the face 30 of the ram 12. The flange 42 has a first pair of opposed notches 44 cut into its exterior perimeter that extend inwardly toward the axial centerline 16 of the ram tool, but only through the flange. The flange 42 also has a second pair of opposed notches 46 cut into its perimeter that extend inwardly through the flange 42 and into the ram 12. The second pair of notches 26 extend longitudinally from the flange 42 to the face 30 of ram 12. The flange and notches are useful in attaching the ram tool 10 to a rivet machine. Thus, the position and dimensions of the flange 42 and the first and second pairs of notches 44 and 46 are dependent upon the brand of manufacture of the rivet machine with which the ram tool of this invention is to be used. Consequently, the flange and notches illustrated are to be taken as exemplary only and are not to be considered critical to the present invention.

A spring device 48 is located within the second cavity 26. The spring device illustrated in FIG. 2 is a conventional liquid spring and includes a spring shaft 50 extending coaxially outwardly from one end. The outer end of the spring shaft 50 impinges the adjacent end of the anchoring slug 34. A compression adjustment screw 52 is mounted in a plate 53 enclosing the outer (upper) end of the second cavity 26. The compression adjustment screw 52 is used to preset the compression of spring device 48 to a predetermined value by applying pressure to the spring device. The actual value of the compression required is dependent upon the type of riveting machine used, the nature and composition of the items being riveted together, the composition of the rivet slug, the diameter of the rivet slug and the length of the rivet slug.

When the spring device 48 is internally bottomed i.e., expanded, it provides a compressive force against the anchoring slug 34 that resists movement of the pogo feet 32 toward the face 30 of ram 12. This force is transferred from the spring device 48 to the pogo feet 32 through the spring shaft 50, the anchoring slug 34 and the pogo rods 28. It is pointed out here that, although a liquid spring is illustrated, any spring device could be used, for example, a mechanical coil spring. The spring device 48 is mounted such that any movement of pogo feet 32 toward face 30 of ram 12 tends to compress the spring device 48. Movement of the pogo feet is therefore resisted by a force equal to the compressive force of the spring device. As a result, it will be appreciated that the pogo rods 28 remain in position fully extended past face 30 unless acted upon by a longitudinal force opposite to, and greater than, the compressive force of the spring device 48.

Figure 4:
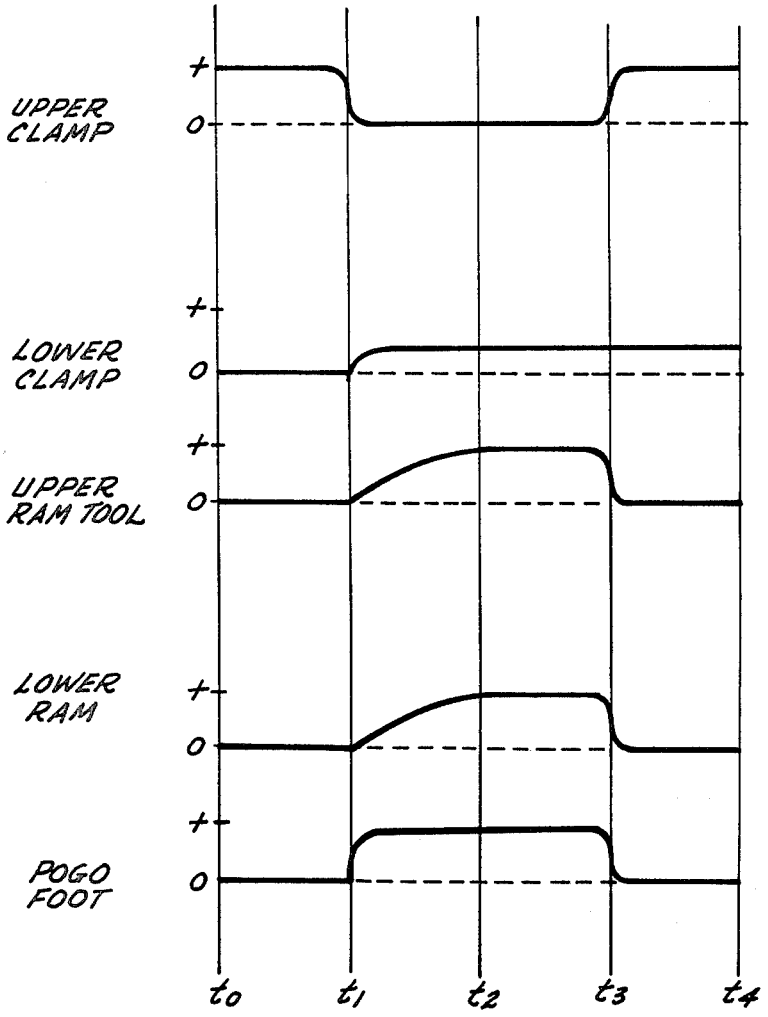
FIG. 4 is an idealized sequence graph illustrating the sequence of forces applied to the clamps and rams in accordance with the process of the invention; and, FIG. 5 is a block diagram illustrating in block form an apparatus for carrying out the inventive process.

FIG. 4 illustrates in idealized form the application of forces to the upper and lower clamps and to the upper and lower rams and to the cylinder, rod and pogo foot assembly all mounted in and forming a part of a rivet machine.

FIGS. 3A–D, which should be viewed in conjunction with FIG. 4, illustrate the movement of the upper ram 12, a lower ram 54 and the pogo feet 32 in accordance with the process of this invention. Initially, two panels, or other items to be joined by rivets, herein referred to as upper panel 56 and lower panel 58 (FIG. 3A), are brought together and clamped by an upper clamp 60 and lower clamp 62 in a conventional manner. Preferably the upper and lower clamps are cylindrical and have aligned cylindrical bores 64 and 65. After the panels are clamped, a rivet hole 66 is drilled, by means not illustrated, through the two panels. The rivet hole 66 is in general alignment with bores in the clamps. Thereafter, by means also not shown, a nonheaded rivet slug 68 is inserted into the hole 66 in the panels. All of the foregoing steps occur during the time period $t_0$–$t_1$, illustrated in FIG. 4.

Following the insertion of the rivet slug 68 into the hole 66, the ram tool 10 and the lower ram 54 are brought into vertical alignment with the bores 64 and 65 in the upper and lower clamps, respectively, and thus into alignment with the central vertical axis of the rivet slug. FIG. 3A illustrates a point in the process where the rivet slug is resting on the lower ram 54 and the upper ram tool 10 is ready to begin its downward movement. At this time the lower ram is vertically fixed at a position slightly below the upper tip of the lower clamp. Thus, a cavity surrounds the lower end of the rivet slug 68. As the upper ram tool 10 moves downward, the pogo feet 32 impinge on the upper panel 56. The compressive force of the spring device 48 is sufficient to overcome the upward force of the lower clamp 62 and, thus, the workpanel 56 is gently pushed away from the upper clamp 60, as illustrated in FIG. 3B. The time at which the pogo feet 32 engage the upper panel 56 is $t_1$ in FIG. 4. The panel is pushed away from the upper clamp 60 by a distance determined by the amount by which the pogo feet 32 extend past the rivet impinging face 30 of the upper ram 12. When this point is reached, the upper ram motion down terminates and it is locked in position. At this time, the slug is positioned for the start of the head forming process. That is, at the end of the step illustrated in FIG. 3B (e.g., when the upper ram is locked in position), a predetermined portion of each end of the slug extends past the associated surfaces of the panels being riveted together. It is at this time that head formation begins. At about this time, the lower ram 54 begins to move upward. This upward movement presses the rivet slug 68 against the face 30 of the upper ram and a squeeze force is exerted on the slug. The lower end of the rivet slug is partially upset and a lower head 70 is partially formed in a cavity 74 defined by the adjacent end of the lower ram 54. The partially formed head establishes a mechanical lock against the lower surface of the lower panel as illustrated in FIG. 3C. This action takes place during the period $t_1$–$t_2$ of FIG. 4. As the lower head 70 is partially formed, the force of the lower ram 54 is partially transmitted through the lower rivet head to the upper and lower panels 56 and 58. The force applied to the lower ram increases, and at some point overcomes the compressive force of the spring device 48. As a result, the pogo feet 32 retract and the lower ram force is applied, via the rivet slug, to the upper ram 12. As a result, the top portion of the rivet is deformed into a head. Simultaneously the formation of the lower head is completed. This action occurs during the period $t_2$–$t_3$ of FIG. 4.

It will be appreciated from the foregoing discussion that the squeeze (compression) force applied to the rivet slug causes the slug to deform and rivet heads to be formed in the top and bottom of the rivet in accordance with the facing surfaces of the upper and lower rams. In this regard, as illustrated by FIGS. 3A–E, by way of example, the cavity or facing surface 74 of the lower ram 54 is such that a semisperical lower head is formed. The upper ram rivet-impinging face 30 is formed such that the upper head has a conical depression. These head shapes, of course, are merely exemplary and it is to be understood that other head shapes can be formed, as desired.

After both upper and lower heads have been formed, between times $t_3$ and $t_4$, the ram forces are removed and the clamp forces retained to hold the panel during any subsequent surfacing work, such as shaving the upper rivet head using a suitable tool (not shown). This would be done if the outer surface of the panel is to be smooth, as required for an aircraft wing, for example. Alternatively, both the ram and clamp forces could be removed if the panel is to be moved to a new position and the riveting process repeated at a new location on the panel.

FIG. 5 is a diagram illustrating in block form an apparatus for carrying out the process of the invention, which apparatus forms a part of the invention. More specifically, a variety of hydraulic, pneumatic, electromechanical, or other structural arrangements could be utilized to form an apparatus in accordance with the invention to carry out the process of the invention. Because the individual structural components necesary to form such an apparatus are well known in the art, the disclosure of a specific structural arrangement is not illustrated in the drawings or described herein. Rather, the basic machine concept is illustrated in block form and described in general terms.

The apparatus illustrated in block form in FIG. 5 comprises a master control system 76, a power supply 78, an upper clamp control 80, a lower clamp control 82, an upper ram tool control 84, a lower ram control 86, an upper clamp 88, a lower clamp 90, an upper ram tool 92 and a lower ram 94.

The master control 76 includes the basic controls of a mechanical riveting machine. The master control system could be hydraulic or pneumatic. In any event, the master control system controls the flow of power from the power supply 78 (hydraulic or pneumatic) to the upper and lower clamp controls 80 and 82 and the upper and lower ram controls 84 and 86. Alternatively, the master control 76 could comprise an electrical control system for controlling the application of electrical power from the power supply 78 (electrical in this case) to electromechanical components forming the upper and lower clamp controls 80 and 82 and the upper and lower ram controls 84 and 86.

The upper clamp control 80 controls the movement of the upper clamp 88 and the lower clamp control 82 controls the movement of the lower clamp 90 in accordance with the sequence of operation hereinbefore described. Similarly, the upper ram tool control 84 controls the movement of the upper ram tool 92 and the lower ram control 86 controls the movement of the lower ram 94 in accordance with the sequence of operations hereinbefore described.

It will be appreciated from the description thus far that the actual mechanical system for carrying out the process of the invention can take on a variety of forms, hence this invention should not be considered as limited to any particular mechanical arrangement.

It will be appreciated from the foregoing description of a preferred embodiment of the invention that a new and improved high fatigue, slug squeeze riveting process using nonheaded rivet slugs and apparatus for carrying out the process is disclosed. Further, an upper ram tool is disclosed which enables the process to be carried out using existing riveting machines having fixed upper clamps, without requiring extensive modification of such existing machines.

To compensate for the fixed nature of the upper clamp, the ram tool of the present invention has spring loaded rods with feet, called pogo feet, at one end, which feet impinge on the items to be riveted and push them a distance away from the fixed clamp. The panel pushaway provides a gap between the fixed clamp and the work items in which gap one head of the rivet can be formed.

The use of the spring loaded rods and pogo feet eliminates the necessity of having a retractable or floating clamp. Also, since the panels are moved by means other than using the rivet slug to transfer force to the work items, the shape of the rivet slug becomes immaterial and a simple cylindrical slug having no pre-formed head can be used.

The use of the riveting method disclosed by the present invention allows both the upper and lower heads of the rivet to be formed by squeeze forces, thereby eliminating the vibrate portion of the prior art squeeze-vibrate riveting process. The use of squeeze forces to form both heads of the rivet produces a higher fatigue life rivet joint.

While a preferred embodiment of the process and apparatus of the invention has been illustrated and described, it will be appreciated by those skilled in the art and others, that various changes can be made herein, without departing from the spirit and scope of the invention. Some of the processing steps surrounding the main steps of the invention can vary. For example, the clamping step can occur before or after the panels are moved into position. The drilling of the hole can occur at the same position as insertion of the rivet slug or at a different position, or a plurality of rivet joints can be formed simultaneously, or they can be formed sequentially. In addition, the invention is not limited to joining panels, but can be used to join any types of items suitable for joining by rivet. Moreover, the clamp and ram forces can be applied in directions other than vertical, as convenient. Further, while a liquid spring is illustrated and described, a mechanical spring can also be used to provide tension for the pogo feet. Also, although the illustrated, preferred embodiment uses two rods with feet at one end to push away the work panels, other arrangements could be used, such as more than two rods or rods with no feet, or a hollow cylinder which substantially surrounds the ram. Hence, the invention can be practiced otherwise than as specifically described herein.

I claim:

1. A high fatigue, slug squeeze riveting process comprising the steps of:

clamping together the items to be riveted between a pair of clamps, one of which clamps remains in a fixed position relative to the riveting machine during the rivet forming process;

forming a hole in said items to be riveted together adjacent said pair of clamps;

inserting a nonheaded rivet slug into said hole from one side of said items to be riveted together;

moving spring loaded pogo feet against the side of said items facing said fixed position clamp so as to move said items away from said fixed position clamp;

pressing said rivet slug in the same direction as movement of said items to be riveted together until the rivet slug reaches a position such that a portion of said rivet slug extends outwardly from both ends of said hole;

applying a force to said rivet slug opposite said pressing direction so as to partially form a first head on the end of said rivet slug opposite said fixed position clamp;

increasing said force opposite said pressing direction after said first head has been partially formed but prior to the completion thereof, until the amount of force transmitted to the pogo feet through said rivet and said items to be riveted together overcomes said spring loading of said pogo feet and moves said items to be riveted together toward said fixed position clamp, said increased force opposite to said pressing direction simultaneously: (i) forming a second head on the end of said rivet slug adjacent said fixed position clamp; and, (ii) completing the forming of said first head.

2. Apparatus for riveting items together through a hole in said items comprising:

(a) first clamp means including a first clamp located on one side of said items;

(b) second clamp means including a second clamp located on the other side of said items, in alignment with said first clamp;

(c) first ram means including a first ram located on said one side of said items, said first ram being adapted to press a rivet slug into said hole, said first ram means further including pushing means located adjacent said first ram and extending a distance beyond the face of said first ram;

(d) second ram means including a second ram located on said other side of said items, in alignment with said first ram;

(e) power supply means for supplying power to said first and second clamp means and to said first and second ram means; and, (f) control means connected so as to control the application of power to said first and second clamp means and to said first and second ram means in a manner such that:

(1) power is applied to said first and second clamp means so that they initially clamp said items together;

(2) power is applied to said first ram means to move said first ram and said pushing means toward said items so as to cause said pushing means to push said items away from said first clamp means and said first ram to impinge on said rivet slug, at which time said first ram means is locked in position; and (3) power is applied to said second ram to move said second ram in the direction of said first clamp means so as to partially form a first head in the end of said rivet slug adjacent to said second ram and, after said first head has been partially formed but prior to completion thereof, overcome the force of said pushing means and simultaneously: (i) form a second head in the end of said rivet slug adjacent to said first ram and (ii) complete the formation of said first head.

3. In riveting machines having two clamps, one of which remains in a fixed position relative to said machine during the rivet forming process, and including pushing means for pushing the items to be riveted together away from said fixed position clamp a predetermined distance prior to the application of an upset force to a rivet slug to deform said rivet slug into a rivet, the improvement comprising:

force means for applying a push-away force to said pushing means while said rivet is being upset by said upset force, said push-away force being of a constant magnitude throughout the rivet forming process, said push-away force being high enough so that a head is partially but not completely formed in the end of said rivet opposed to said fixed position clamp prior to the formation of a head in the end of said rivet adjacent to said fixed position clamp, said push-away force also being low enough so that a head is formed in the end of the rivet adjacent to said fixed position clamp simultaneously with the completion of the head formed in the end of the rivet opposed to the fixed position clamp.

4. The improvement claimed in claim 3 wherein said force means includes spring means for applying said push-away force to said pushing means.

5. The improvement claimed in claim 4 wherein:

(a) the end of said rivet adjacent to said fixed clamp is upset by a cylinder having a rivet impinging face at one end;

(b) said cylinder has at least two apertures in said rivet impinging face, said apertures located on a diameter of said cylinder on opposite sides of the longitudinal axis of said cylinder, said apertures extending longitudinally through said cylinder;

(c) said pushing means comprises a rod slidably mounted within each of said at least two apertures, said rods being of length sufficient to extend past said impinging face of said cylinder a predetermined distance; and, (d) said spring means applies said push-away force to said rods.

6. The improvement claimed in claim 5 wherein said spring means comprises a liquid spring, said liquid spring being adjustable to a predetermined compression.

7. The improvement claimed in claim 5 wheren said spring means comprises a mechanical spring.

8. The improvement claimed in claim 5 wherein each of said rods has attached at the end extending past said rivet impinging face a foot, said feet being larger than said apertures in which said rods are mounted.

9. The improvement claimed in claim 4 wherein said spring means comprises a liquid spring, said liquid spring being adjustable to a predetermined compression.

10. The improvement claimed in claim 4 wherein said spring means comprises a mechanical spring.

11. In riveting machines having two clamps, one of which remains in a fixed position relative to said machine during the rivet forming process, the improvement comprising ram tool means for pushing the items to be riveted together away from said fixed position clamp a predetermined distance prior to the application of force to a rivet slug to deform said rivet slug into a rivet, said ram tool means comprising:

first means for applying a force on one end of a non-headed rivet slug including a cylinder having a rivet impinging face on one end;

second means for pushing said items to be riveted together away from said fixed position clamp, said second means located adjacent said first means and extending past said rivet impinging face of said cylinder a predetermined distance, said second means including spring means for providing a force to push away said items to be riveted together and force transfer means extending from said spring means to a point beyond said rivet impinging face of said cylinder, said cylinder having at least two apertures formed in said rivet impinging face, said apertures located on a diameter of said cylinder on opposite sides of the longitudinal axis of said cylinder, said apertures extending longitudinally through said cylinder, said force transfer means including a rod slidably mounted within each of said at least two apertures, said rod being of length sufficient to extend past said impinging face of said cylinder a predetermined distance, each of said rods having a foot attached at the end thereof extending past said rivet impinging face, said foot being larger than said aperture in which said rod is mounted.

12. The improvement of claim 11 wherein said spring means comprises a liquid spring, said liquid spring being adjustable to a predetermined tension.

13. The improvement claimed in claim 11 wherein said spring means comprises a mechanical spring.

* * * * *